US008265504B2

(12) United States Patent
Chang et al.

(10) Patent No.: US 8,265,504 B2
(45) Date of Patent: Sep. 11, 2012

(54) IMAGING SYSTEM WITH PRESSURE FIXING AND SEPARATE THERMAL FIXING OF MARKING MATERIALS ON MEDIA

(75) Inventors: Shu Chang, Pittsford, NY (US); John F. Knapp, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 63 days.

(21) Appl. No.: 12/914,264

(22) Filed: Oct. 28, 2010

(65) Prior Publication Data

US 2012/0107026 A1 May 3, 2012

(51) Int. Cl.
*G03G 15/20* (2006.01)

(52) U.S. Cl. ..... 399/68; 399/339

(58) Field of Classification Search ..... 399/67, 399/68, 328, 339; 219/216; 430/124.23
See application file for complete search history.

(56) References Cited

U.S. PATENT DOCUMENTS

| | | | | |
|---|---|---|---|---|
| 4,444,486 | A * | 4/1984 | Monkelbaan | 399/339 |
| 5,519,484 | A * | 5/1996 | Kumagai | 399/364 |
| 6,125,248 | A * | 9/2000 | Moser | 399/68 |
| 6,615,018 | B2 * | 9/2003 | Funato | 399/322 |
| 6,853,813 | B2 * | 2/2005 | Miyazaki | 399/2 |
| 6,980,762 | B2 * | 12/2005 | Bogoshian | 399/328 |
| 7,486,902 | B2 * | 2/2009 | Hashimoto et al. | 399/68 |
| 7,783,242 | B2 * | 8/2010 | Chigono et al. | 399/341 |
| 2008/0075490 | A1 * | 3/2008 | Ota et al. | 399/45 |
| 2009/0245896 | A1 * | 10/2009 | Ishikake et al. | 399/328 |
| 2011/0135349 | A1 * | 6/2011 | Knapp et al. | 399/320 |

FOREIGN PATENT DOCUMENTS

| | | | |
|---|---|---|---|
| EP | 1555583 | A2 * | 7/2005 |
| JP | 61148478 | A * | 7/1986 |
| JP | 08272159 | A * | 10/1996 |
| JP | 2006308889 | A * | 11/2006 |

OTHER PUBLICATIONS

John F. Knapp et al.; "Apparatuses Useful in Printing and Methods of Fixing Marking Materials on Media"; U.S. Appl. No. 12/631,381, filed Dec. 4, 2009.

* cited by examiner

*Primary Examiner* — Robert Beatty
(74) *Attorney, Agent, or Firm* — Ronald E. Prass, Jr.; Prass LLP

(57) ABSTRACT

A system for fixing an image on a piece of media is provided. The system has a first enclosure having an image forming section for forming the image on the piece of media and a pressure fixing section that does not include a thermal energy source for fixing the image to the piece of media. The pressure fixing section has a first rotating member, a second rotating member located proximate the first member such that a gap exists between the first member and the second member, the gap being for receiving the piece of media, and a force applying device that applies force to at least one of the first member and the second member to apply pressure to the piece of media such that the image is fixed to the piece of media by the pressure. The apparatus also has a second enclosure having a fixing section that includes a thermal energy source for further fixing the image to the piece of media after the image has been fixed to the media by the pressure fixing section.

23 Claims, 3 Drawing Sheets

IMAGING SYSTEM WITH PRESSURE FIXING AND SEPARATE THERMAL FIXING OF MARKING MATERIALS ON MEDIA

BACKGROUND

The present disclosure relates generally to fixing of images in image forming devices. More particularly, the present disclosure describes an apparatus, method, and system useful for fixing an image on media using cold pressure fusing techniques.

It is becoming more and more important to build devices with environmentally friendly "Green" enabling technologies. One aspect of green printing is reducing the power consumption in xerographic laser printers. Since a major portion of the power supplied to these printers is consumed by fixing marking materials on media, typically through the use of a thermal fuser, it can be important to consider techniques to lower fixing power requirements, such as thermal energy per print. Improvements in reducing thermal energy used by a fuser have been made through instant-on and low-melt toner designs, but there is a need to continue to decrease power consumed by the fixing device even further.

Fixing by mechanical compression (pressure fixing) offers several advantages over thermal fusing. A printer using a fixing device that does not include a thermal energy source, such as by pressure alone, can provide an energy reduction of more than 50% compared to thermal fusing. Other advantages of pressure fixing devices include no standby power, instant on, robust fuser rolls that last the life of machine, increased fixing device reliability, reduced fuser service costs, fast first copy out time, process speed insensitivity, reusable fixer hardware, reduced emissions, reduced noise, no cooling requirement and no fuser edge-ware issues. However, pressure fixing can result in image fix somewhat less permanent than fusing methods that involve heating the toner image. Some other disadvantages of pressure fixing can include high image gloss, paper damage under high pressure, increased fixing device weight, and fix permanence being substrate type and width dependent.

SUMMARY

An apparatus for fixing an image to a piece of media is provided. The apparatus has a first enclosure having an image forming section for forming the image on the piece of media and a pressure fixing section that does not include a thermal energy source for fixing the image to the piece of media. The pressure fixing section has a first rotating member that does not include a thermal energy source, a second rotating member that does not include a thermal energy source, the second member being located proximate the first member such that a gap exists between the first member and the second member, the gap being for receiving the piece of media, and a force applying device that applies force to at least one of the first member and the second member to apply pressure to the piece of media when the piece of media is located in the gap such that the image is fixed to the piece of media by the pressure. The apparatus also has a second enclosure separate from and attachable to the first enclosure, the second enclosure having a fixing section that includes a thermal energy source for further fixing the image to the piece of media after the image has been fixed to the media by the pressure fixing section, the fusing section that includes a thermal energy source further fixing the image to the piece of media by applying heat to the image on the piece of media.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

DETAILED DESCRIPTION

Figure 1:
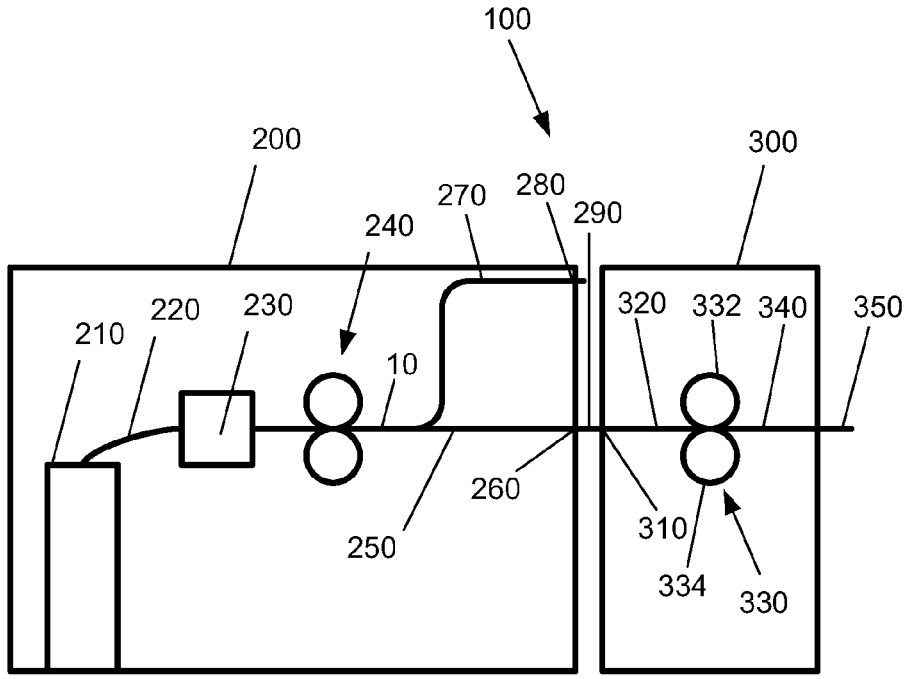
FIG. 1 is an exemplary schematic diagram of an imaging system in accordance with embodiments of the disclosure.

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

The disclosed embodiments may include an apparatus for fixing an image to a piece of media. The apparatus has a first enclosure having an image forming section for forming the image on the piece of media and a pressure fixing section that does not include a thermal energy source for fixing the image to the piece of media. The pressure fixing section has a first rotating member that does not include a thermal energy source, a second rotating member that does not include a thermal energy source, the second member being located proximate the first member such that a gap exists between the first member and the second member, the gap being for receiving the piece of media, and a force applying device that applies force to at least one of the first member and the second member to apply pressure to the piece of media when the piece of media is located in the gap such that the image is fixed to the piece of media by the pressure. The apparatus also has a second enclosure separate from and attachable to the first enclosure, the second enclosure having a fixing section that includes a thermal energy source for further fixing the image to the piece of media after the image has been fixed to the media by the pressure fixing section, the fusing section that includes a thermal energy source further fixing the image to the piece of media by applying heat to the image on the piece of media.

The disclosed embodiments may further include a method for fixing an image on a piece of media. The method including introducing the piece of media to a first enclosure; forming an image on the piece of media with an image forming section located in the first enclosure; fixing the image to the piece of media with a pressure fixing section that does not include a thermal energy source located in the first enclosure, the pressure fixing section having a first rotating member that does not include a thermal energy source and a second rotating member that does not include a thermal energy source, the second member being located proximate the first member such that a gap exists between the first member and the second member, the gap being for receiving the piece of media, the fixing being achieved by applying pressure to the piece of media by applying a force to at least one of the first member and the second member when the piece of media is located in the gap; after fixing the image to the piece of media in the pressure fixing section, introducing the piece of media into a second enclosure separate from and attachable to the first enclosure; and further fixing the image to the piece of media with a fixing section that includes a thermal energy source located in the second enclosure, the fixing section that includes a thermal energy source further fixing the image to the piece of media by applying heat to the image on the piece of media.

The disclosed embodiments may further include a system for fixing an image on a piece of media. The system has a first enclosure having an image forming section for forming the image on the piece of media and a pressure fixing section for fixing the image to the piece of media while operating at a reasonable room temperature. The pressure fixing section having a first rotating member, a second rotating member located proximate the first member such that a gap exists between the first member and the second member, the gap being for receiving the piece of media, and a force applying device that applies force to at least one of the first member and the second member to apply pressure to the piece of media when the piece of media is located in the gap such that the image is fixed to the piece of media by the pressure. The system also having a second enclosure separate from and attachable to the first enclosure, the second enclosure having a fixing section that includes a thermal energy source for further fixing the image to the piece of media after the image has been fixed to the media by the pressure fixing section, the fixing section that includes a thermal energy source further fixing the image to the piece of media by applying heat to the image on the piece of media.

It has been estimated that approximately ⅓ of all printed documents are thrown away within a day or two in a typical modern office environment. In the modern world most data and image storage is electronic in nature, requiring no paper backup. This implies that many documents produced do not require archival image permanence.

This disclosure includes embodiments that use a pressure fixing station that does not include a thermal energy source as the only resident fixing device in a first enclosure of a printing system. A device that uses a thermal energy source to fuse the toner image to the media resides in a separate and attachable second enclosure. The first enclosure with the pressure fixing device produces prints for daily usage. It is very low in power consumption and is environmentally friendly. The absence of a fuser that does include a thermal energy source can also result in a significantly reduction in the instant-on time. The enclosure with the pressure fixing device is very energy efficient. The attachable second enclosure enables the higher image quality and archival quality when desired. Since the device that uses a thermal energy source is not constantly in use, the two enclosures together as a whole will consume much less energy as compared to typical printing systems with only devices that use a thermal energy source for fixing.

This disclosure includes embodiments that use a pressure fixing station that fixes an image to a piece of media while operating at a reasonable room temperature. Like in other embodiments, the pressure fixing station is the only resident fixing device in a first enclosure of a printing system. For the purposes of this application, the term "reasonable room temperature" includes temperatures from about 50° F. to about 100° F. Pressure fixing stations can apply pressure to the toner on the media in the range of about 500 psi to about 5000 psi. As new toners and media are developed, this pressure range may change. In pressure fixing, the toner typically does not go through a phase change as it is subjected to the pressure of the fixing process.

Typical devices that use a thermal energy source (sometimes referred to as "thermal fusers") operate at temperatures greater than about 212° F. and pressures less than about 200 psi. As new toners and media are developed, this pressure range may change. In thermal fusers, the toner typically goes through a phase change as it is subjected to the heat and pressure of the thermal fusing process.

FIG. 1 illustrates an exemplary printing apparatus 100. As used herein, the term "printing apparatus" encompasses any apparatus, such as a digital copier, bookmaking machine, multifunction machine, and the like, that performs a print outputting function for any purpose. Printing apparatus 100 can be used to produce prints from various types of media, such as, for example, coated or uncoated (plain) paper sheets, at different speeds. The media can have various sizes and weights. In embodiments, printing apparatus 100 includes a first enclosure 200 and a second enclosure 300. Both first enclosure 200 and second enclosure 300 can have various configurations. As shown, first enclosure 200 includes a media feeder 210 connected to an image forming device 230 by a media path 220.

In first enclosure 200, media feeder 210 is adapted to feed media having various sizes (widths and lengths) and weights to image forming device 230. In an exemplary image forming device 230, toner is developed from one or more developer stations to a charged photoreceptor belt or roll to form a toner image on the photoreceptor belt or roll. The toner image is transferred to a piece of media 10 fed through image forming device 230. The media is advanced to a pressure fixing device 240 to fix the toner image on the media.

Figure 2:
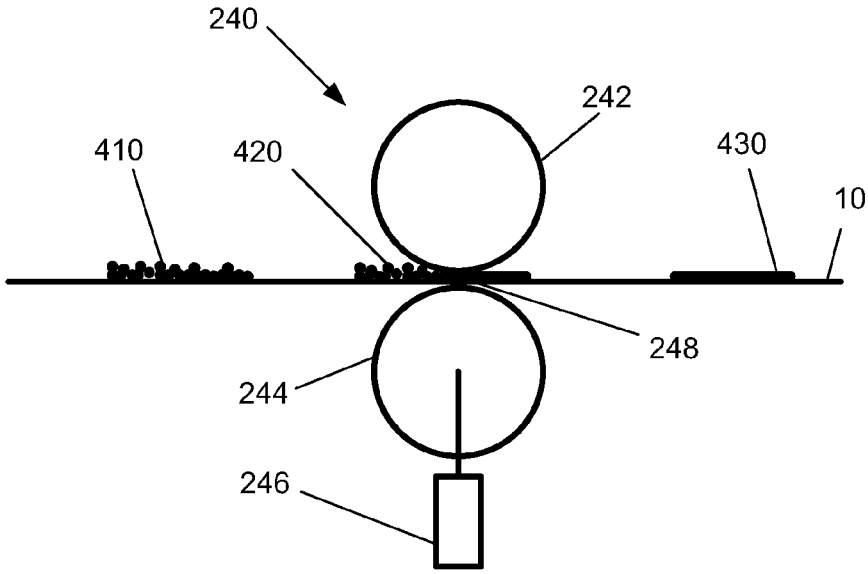
FIG. 2 is an exemplary diagram of a fixing section that does not include a thermal energy source in accordance with embodiments of the disclosure.

FIG. 2 illustrates an example of a pressure fixing device in accordance with the disclosure. Pressure fixing device 240 has, in this example, a first rotating member 242 and a second rotating member 244. First rotating member 242 and second rotating number 244 can be, for example, belts or rolls. In the example shown in FIG. 2, both rotating members are shown as rolls. One or both of the first rotating member 242 and the second rotating member 244 can be pressed toward the other by an urging device. FIG. 2 shows an urging device 246 that presses second rotating number 244 toward first rotating member 242. Urging device 246 can be, for example, a hydraulic or pneumatic cylinder, an electric actuator, a spring, or other device that can press one rotating member toward another.

Some embodiments constantly maintain first rotating member 242 and second rotating member 244 in positions at which first rotating member 242 and second rotating member 244 apply pressure on each other. Other embodiments move first rotating member 242 and second rotating member 244 into a position at which first rotating member 242 and second rotating member 244 apply pressure on each other only when a piece of media is present between first rotating member 242 and second rotating member 244.

FIG. 2 illustrates an image 410 formed on a sheet of media 10 prior to entering a gap 248 between first rotating member 242 and second rotating member 244. Image 410 is created in image forming device 230 and has not yet been fixed, or fused, to media 10. As image 410 enters gap 248 (shown as image 420), pressure is applied to the image to fix the image to media 10. A fixed image 430 is present on media 10 after it has been subjected to the pressure applied in gap 248 by first rotating member 242 and second rotating member 244.

Referring now back to FIG. 1, first enclosure 200 has two media paths leading from pressure fixing device 240 to exits from first enclosure 200. Media path 270 leads media to media exit 280 after which the media can be held in a tray or other collection device. Media path 270 is for those pieces of media having images that are sufficiently fixed by pressure fixing device 240 alone. Those pieces of media that are to be subjected to further fixing are directed along a media path 250 to a media exit 260. Media pieces directed to media exit 260 are fed long media path 290 and into second enclosure 300 for further image fixing.

Second enclosure 300 is a separate and detachable unit that, in this figure, is attached to first enclosure 200. Second enclosure 300 has, in this example, a media entrance 310 for receiving media from media path 290, and a media path 320 for feeding media into a thermal fuser 330. Thermal fuser 330 can be any fuser that includes a thermal energy source to fix images onto media. For example, thermal fuser 330 can use heat alone, or heat in combination with pressure to fix the images. In this example, thermal fuser 330 has a first rotating member 332 and a second rotating member 334. Heat is applied to images on pieces of media that enter second enclosure 300 by passing them between first rotating member 332 and second rotating member 334. A piece of media that enters second enclosure 300 has an image fixed on it by pressure fixing device 240 in first enclosure 200. The image is further fixed to the piece of media by thermal fuser 330 in order to make a final print having an image that is more permanent and/or better quality than the image leaving first enclosure 200.

After the image is further fixed by thermal fuser 330, it moves along media path 340 and exits second enclosure 300 at media exit 350, after which the media can be held in a tray or other collection device.

Figure 3:
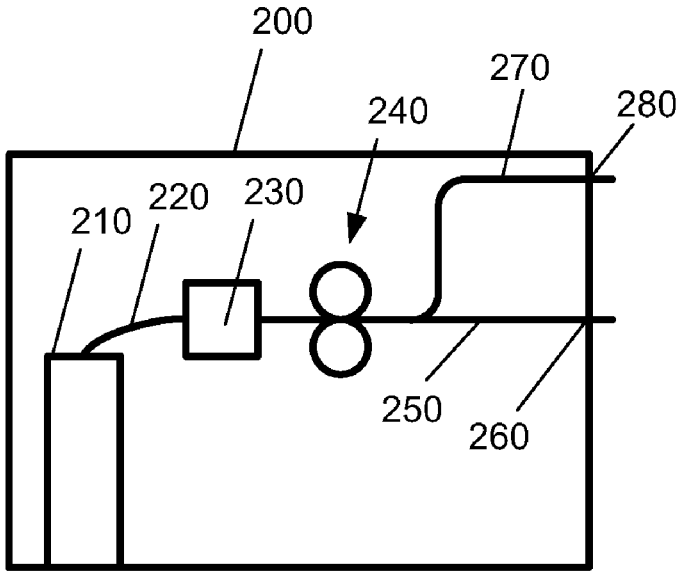
FIG. 3 is an exemplary schematic diagram of an imaging system in accordance with embodiments of the disclosure.
Figure 4:
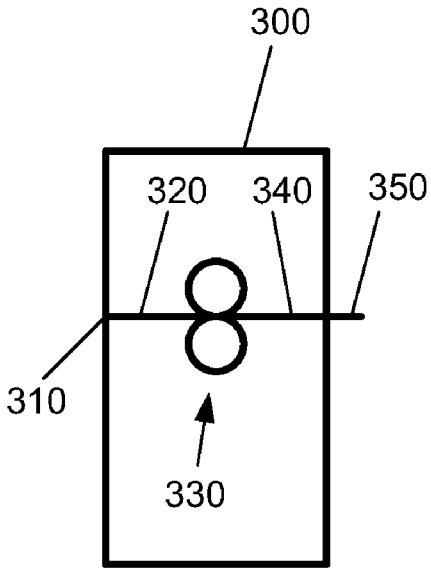
FIG. 4 is an exemplary schematic diagram of a second enclosure in accordance with embodiments of the disclosure.

FIG. 1 shows first enclosure 200 and second enclosure 300 connected at media path 290 as a single system. FIGS. 3 and 4 show first enclosure 200 and second enclosure 300 separated as standalone devices. By separating the two enclosures, multiple first enclosures 200 can be used with one second enclosure 300. An office having a total printing volume requiring multiple printing devices may have a need for only a fraction of its total printing volume to be fixed with a thermal fuser. In this situation, the office may have multiple printing devices such as first enclosure 200 and only one fixing device such as second enclosure 300. The majority of prints will be removed from one of the first enclosures 200 and used by the office staff. The small percentage of prints that require better quality and/or more permanence can be carried over to the second enclosure 300 for further image fixing. Also, it is noted that it is not always known when a print is made whether that print will need added quality and/or permanence. By having a separate second enclosure including a thermal fuser, a print that is later determined to need thermal fusing can be carried to the separate second enclosure and further fixed. By providing separate enclosures/devices for the two types of fusers, (1) energy is saved by only using the thermal fuser on those prints that require added permanence and/or quality, and (2) capital expenditure can be reduced by not paying for a thermal fuser in every printing device.

Figure 5:
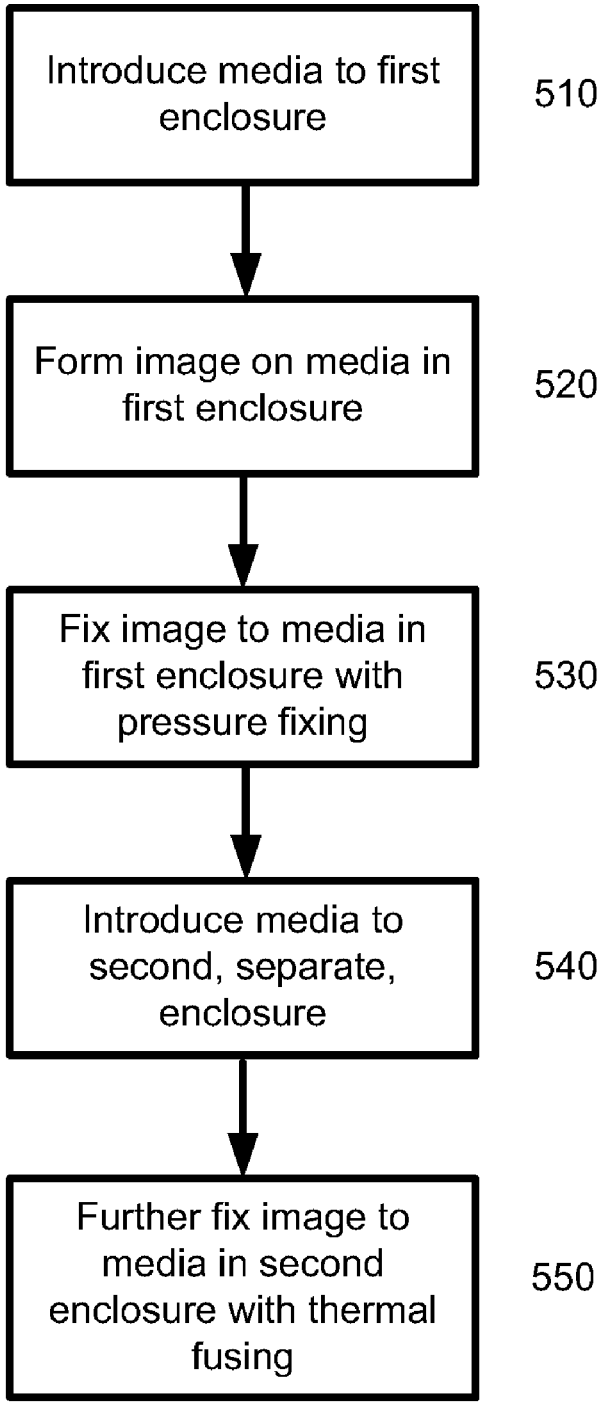
FIG. 5 shows a method in accordance with embodiments of the disclosure.

FIG. 5 shows an exemplary method in accordance with embodiments of the disclosure. In 510 media is introduced into the first enclosure at, for example, media feeder 210. In 520 an image is formed on the media by, for example, image forming device 230. In 530 the image is fixed with pressure fixing by, for example, pressure fixing device 240. In 540 the media containing the fixed image is introduced to a second, separate enclosure such as, for example, second enclosure 300. In 550 the image is further fixed to the media with thermal fusing by, for example, thermal fuser 330.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions that are suitable for xerographic fusing.

As used herein, the term "printing apparatus" encompasses any apparatus that performs a print outputting function for any purpose. Such apparatuses can include, e.g., a digital copier, bookmaking machine, multifunction machine, and the like. The printing apparatuses can use various types of solid and liquid marking materials, including toner and inks (e.g., liquid inks, gel inks, heat-curable inks and radiation-curable inks), and the like. The printing apparatuses can use various thermal, pressure and other conditions to treat the marking materials and form images on media.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A system for fixing an image on a piece of media, the system comprising: a first enclosure having an image forming section for forming the image on the piece of media; and a pressure fixing section that does not include a thermal energy source for fixing the image to the piece of media, the pressure fixing section having a first rotating member that does not include a thermal energy source, a second rotating member that does not include a thermal energy source, the second member being located proximate the first member such that a gap exists between the first member and the second member, the gap being for receiving the piece of media, and a force applying device that applies force to at least one of the first member and the second member to apply pressure to the piece of media when the piece of media is located in the gap such that the image is fixed to the piece of media by the pressure, wherein the first enclosure further comprises a first media exit where the media exits the first enclosure, and a second media exit where the media exits the first enclosure; and a second enclosure separate from and attachable to the first enclosure, the second enclosure having a fixing section that includes a thermal energy source for further fixing the image to the piece of media after the image has been fixed to the media by the pressure fixing section, the fixing section that includes a thermal energy source further fixing the image to the piece of media by applying heat to the image on the piece of media.

2. The system of claim 1, wherein the first member is a roll.

3. The system of claim 2, wherein the second member is a roll.

4. The system of claim 3, wherein the first member has a surface finish and the second member has a surface finish, and the surface finish of the first member is the same as the surface finish of the second member.

5. The system of claim 4, wherein the first member and the second member are ceramic.

6. The system of claim 1, wherein the first member has a surface finish and the second member has a surface finish, and the surface finish of the first member is the same as the surface finish of the second member.

7. The system of claim 6, wherein the first member and the second member are ceramic.

8. The system of claim 1, wherein the pressure fixing section is the only image fixing device enclosed in the first enclosure.

9. The system of claim 4, wherein the second enclosure further comprises a media entrance, and the second media exit of the first enclosure aligns with the media entrance of the second enclosure such that media exiting the first enclosure through the second media exit is routed into the second enclosure through the media entrance of the second enclosure.

10. The system of claim 9, wherein the first media exit of the first enclosure aligns with no media entrance of the second enclosure such that media exiting the first enclosure through the first media exit is routed away from any media entrance of the second enclosure.

11. The system of claim 10, further comprising a controller that controls whether the piece of media exits the first enclosure through the first media exit or the second media exit.

12. The system of claim 1, wherein the second enclosure further comprises a media entrance, and the second media exit of the first enclosure aligns with the media entrance of the second enclosure such that media exiting the first enclosure through the second media exit is routed into the second enclosure through the media entrance of the second enclosure.

13. The system of claim 12, wherein the first media exit of the first enclosure aligns with no media entrance of the second enclosure such that media exiting the first enclosure through the first media exit is routed away from any media entrance of the second enclosure.

14. The system of claim 13, wherein the second enclosure further comprises a power supply that provides power to the thermal fusing section.

15. The system of claim 14, further comprising a controller that controls whether the piece of media exits the first enclosure through the first media exit or the second media exit.

16. The system of claim 1, wherein the pressure fixing section fixes the image to the piece of media while operating at a temperature between about 50° F. and about 100° F.

17. The system of claim 1, wherein the pressure fixing section fixes the image to the piece of media while subjecting the image to a pressure of between about 500 psi and about 5000 psi.

18. A method for fixing an image on a piece of media, the method comprising:

introducing the piece of media to a first enclosure;

forming an image on the piece of media with an image forming section located in the first enclosure;

fixing the image to the piece of media with a pressure fixing section that does not include a thermal energy source located in the first enclosure, the pressure fixing section having a first rotating member that does not include a thermal energy source and a second rotating member that does not include a thermal energy source, the second member being located proximate the first member such that a gap exists between the first member and the second member, the gap being for receiving the piece of media, the fixing being achieved by applying pressure to the piece of media by applying a force to at least one of the first member and the second member when the piece of media is located in the gap, wherein the first enclosure further comprises a first media exit where the media exits the first enclosure, and a second media exit where the media exits the first enclosure;

after fixing the image to the piece of media in the pressure fixing section, introducing the piece of media into a second enclosure separate from and attachable to the first enclosure; and further fixing the image to the piece of media with a fixing section that includes a thermal energy source located in the second enclosure, the fixing section that includes a thermal energy source further fixing the image to the piece of media by applying heat to the image on the piece of media.

19. The method of claim 18, wherein the pressure fixing section fixes the image to the piece of media while operating at a temperature between about 50° F. and about 100° F.

20. The method of claim 18, wherein the pressure fixing section fixes the image to the piece of media while subjecting the image to a pressure of between about 500 psi and about 5000 psi.

21. A system for fixing an image on a piece of media, the system comprising:

a first enclosure having an image forming section for forming the image on the piece of media; and a pressure fixing section for fixing the image to the piece of media while operating at a reasonable room temperature, the pressure fixing section having a first rotating member, a second rotating member located proximate the first member such that a gap exists between the first member and the second member, the gap being for receiving the piece of media, and a force applying device that applies force to at least one of the first member and the second member to apply pressure to the piece of media when the piece of media is located in the gap such that the image is fixed to the piece of media by the pressure, wherein the first enclosure further comprises a first media exit where the media exits the first enclosure, and a second media exit where the media exits the first enclosure; and a second enclosure separate from and attachable to the first enclosure, the second enclosure having a fixing section that includes a thermal energy source for further fixing the image to the piece of media after the image has been fixed to the media by the pressure fixing section, the fixing section that includes a thermal energy source further fixing the image to the piece of media by applying heat to the image on the piece of media.

22. The system of claim 21, wherein the pressure fixing section fixes the image to the piece of media while operating at a temperature between about 50° F. and about 100° F.

23. The system of claim 21, wherein the pressure fixing section fixes the image to the piece of media while subjecting the image to a pressure of between about 500 psi and about 5000 psi.

* * * * *